US011641891B2

(12) United States Patent
Prushiek

(10) Patent No.: US 11,641,891 B2
(45) Date of Patent: May 9, 2023

(54) GARMENT WITH INTEGRATED SOCKS

(71) Applicant: Kathryn Marie Prushiek, Oconomowoc, WI (US)

(72) Inventor: Kathryn Marie Prushiek, Oconomowoc, WI (US)

( * ) Notice: Subject to any disclaimer, the term of this patent is extended or adjusted under 35 U.S.C. 154(b) by 184 days.

(21) Appl. No.: 17/328,906

(22) Filed: May 24, 2021

(65) Prior Publication Data

US 2021/0360985 A1 Nov. 25, 2021

Related U.S. Application Data

(63) Continuation-in-part of application No. 29/738,840, filed on Jun. 19, 2020.

(60) Provisional application No. 63/029,274, filed on May 22, 2020.

(51) Int. Cl.
*A41D 1/06* (2006.01)
*A41B 11/01* (2006.01)

(52) U.S. Cl.
CPC ..... *A41D 1/06* (2013.01); *A41B 11/01* (2013.01)

(58) Field of Classification Search
CPC ..... A41D 1/06; A41D 11/00; A41B 11/01; A41B 13/04
See application file for complete search history.

(56) References Cited

U.S. PATENT DOCUMENTS 615,271 A * 12/1898 Hayden et al. ..... A41B 11/00 2/239
2,502,393 A * 3/1950 Sladek et al. ..... A41D 1/06 446/28
6,105,173 A * 8/2000 Brown ..... A41B 11/00 2/239
6,141,802 A * 11/2000 Drake ..... A41D 1/08 2/22
6,247,183 B1 * 6/2001 Haas-Laursen ..... A41F 13/00 2/239
7,051,374 B1 * 5/2006 Grilliot ..... A41F 1/002 2/69
8,028,351 B2 * 10/2011 Stachler ..... A62B 17/006 2/457

(Continued)

FOREIGN PATENT DOCUMENTS

CN 204207087 U 3/2015
GB 190404723 A 3/1904

OTHER PUBLICATIONS

Sockatoos, https://sockatoos.co.uk/pages/what-are-sockatoos.

(Continued)

*Primary Examiner* — Khaled Annis

(57) ABSTRACT

A garment with integrated socks is a novel clothing design used to provide a functional one-piece lower-body garment for young children camouflaged as a conventional pair of pants and socks. The garment with integrated socks utilizes a foot covering and a leg covering with a first mounting seam and a second mounting seam, respectively, with the first mounting seam being engaged to the second mounting seam with at least one interstitial binding. The foot covering and the leg covering may be sourced from any conventional garments configurable to attach via the interstitial binding, thereby enabling a user to selectively introduce various styles and varieties of existing clothing into a single instance of the present invention.

19 Claims, 8 Drawing Sheets

(56) References Cited

U.S. PATENT DOCUMENTS

| | | | | |
|---|---|---|---|---|
| 11,464,665 | B2 * | 10/2022 | Kelly | A61F 5/32 |
| 2001/0008027 | A1 * | 7/2001 | Duplock | B32B 27/12 2/69 |
| 2001/0025383 | A1 * | 10/2001 | Thompson | A41D 13/02 2/234 |
| 2003/0154535 | A1 * | 8/2003 | Crooks St. Pierre | A41B 13/005 2/80 |
| 2005/0176324 | A1 * | 8/2005 | Michel | A41B 11/14 2/241 |
| 2006/0117598 | A1 * | 6/2006 | Czaplewski | A43B 3/242 36/7.1 R |
| 2006/0218698 | A1 * | 10/2006 | Toyne | A41D 1/06 2/231 |
| 2009/0313741 | A1 * | 12/2009 | Hyman | A41D 10/00 2/83 |
| 2011/0138522 | A1 * | 6/2011 | Grilliot | A41D 13/06 2/455 |
| 2014/0366237 | A1 * | 12/2014 | Boudreau | A41B 11/00 2/69 |
| 2016/0198782 | A1 * | 7/2016 | Thompson | A41D 19/0041 2/270 |
| 2018/0027896 | A1 * | 2/2018 | Stobar | A41B 13/005 |
| 2018/0042310 | A1 * | 2/2018 | Mortimer | A41B 13/005 |
| 2018/0289081 | A1 * | 10/2018 | Schierenbeck | A41D 13/0002 |
| 2019/0116894 | A1 * | 4/2019 | Brannon | A41F 1/00 |
| 2019/0335827 | A1 * | 11/2019 | Bitton | A41D 19/01 |
| 2021/0137179 | A1 * | 5/2021 | Zaki | A41D 11/00 |
| 2021/0196007 | A1 * | 7/2021 | Haugen | A41D 13/0005 |
| 2021/0196009 | A1 * | 7/2021 | Haugen | A41D 13/0005 |
| 2021/0212387 | A1 * | 7/2021 | McDonald | A41B 11/12 |
| 2021/0360985 | A1 * | 11/2021 | Prushiek | A41B 13/04 |
| 2021/0392976 | A1 * | 12/2021 | Johnson | A41D 11/00 |

OTHER PUBLICATIONS

Baby Epi Leggings, https://www.maisonette.com/shop/baby/girl-clothing/pants/baby-epi-leggings-with-feet-light-grey.
Tibi, https://www.pinterest.es/pin/560346378628990159/.

* cited by examiner

GARMENT WITH INTEGRATED SOCKS

The current application claims a priority to the U.S. Provisional Patent application Ser. No. 63/029,274 filed on May 22, 2020. The current application is filed on May 24, 2021, whereas May 22, 2021 and May 23, 2021 were on a weekend.

FIELD OF THE INVENTION

The present invention relates generally to the construction of coveralls, specifically articles of children's clothing comprising both legwear and footwear.

BACKGROUND OF THE INVENTION

It is well known to wear socks with one or more other items of clothing in order to keep the user's feet warm. The socks also typically prevent rubbing and increase the comfort of a user wearing shoes. A common problem, particularly with babies and young children, is that one or both of the socks can become detached from the user's feet, such that the user's feet get cold and/or the one or more socks become lost. This is particularly the case when the baby is crawling and is not yet able to walk, since the action of crawling typically moves the socks in a direction opposite to the direction of travel and other clothing of the baby. This problem also results in discomfort to the baby caused by the garment becoming twisted around a part of the baby's body. Furthermore, socks often become lost during the process of washing and, even if the socks are not lost during washing, it is time consuming for a user to match up socks to form a pair before putting the socks away for storage prior to use. Therefore, it is an objective of the present invention to provide a novel means of integrating socks along legwear.

The present invention features legwear with integrated socks sewn in, preventing the loss of the socks when worn by a baby or a young child. Additionally, the integrated socks along the legwear prevents the socks from displacing in an uncomfortable position. Furthermore, the integration of socks along legwear prevents the loss and mis-match of socks normally associated with washing socks separately from legwear.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIG. 1 through 8, the present invention is a garment with integrated socks comprising a foot covering 10 and a leg covering 20. The foot covering 10 broadly refers to any identifiable article of clothing, extant or manufactured wholly for assembly into the present invention, that is commonly worn on or about the foot. More specifically, the foot covering 10 is ideally a sock sized to match the leg covering 20. Accordingly, the leg covering 20 refers to any type or variety of pants onto which the foot covering 10 may be attached to create a suitable coverall or 'onesie'.

Figure 1:
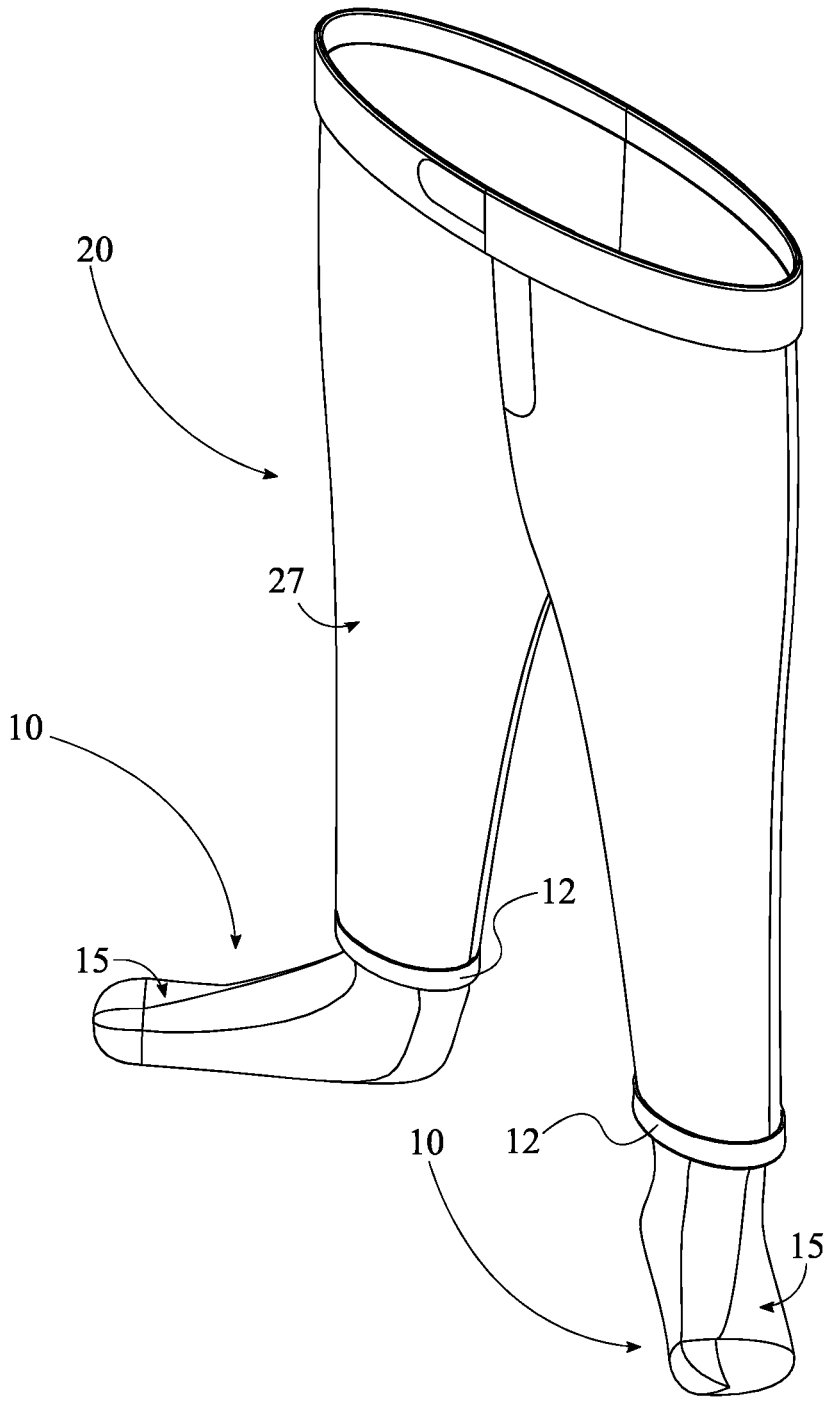
FIG. 1 is a top-front-left perspective view of one embodiment of the present invention, wherein multiple alternate configurations of the present invention are shown in a single instance.
Figure 5:
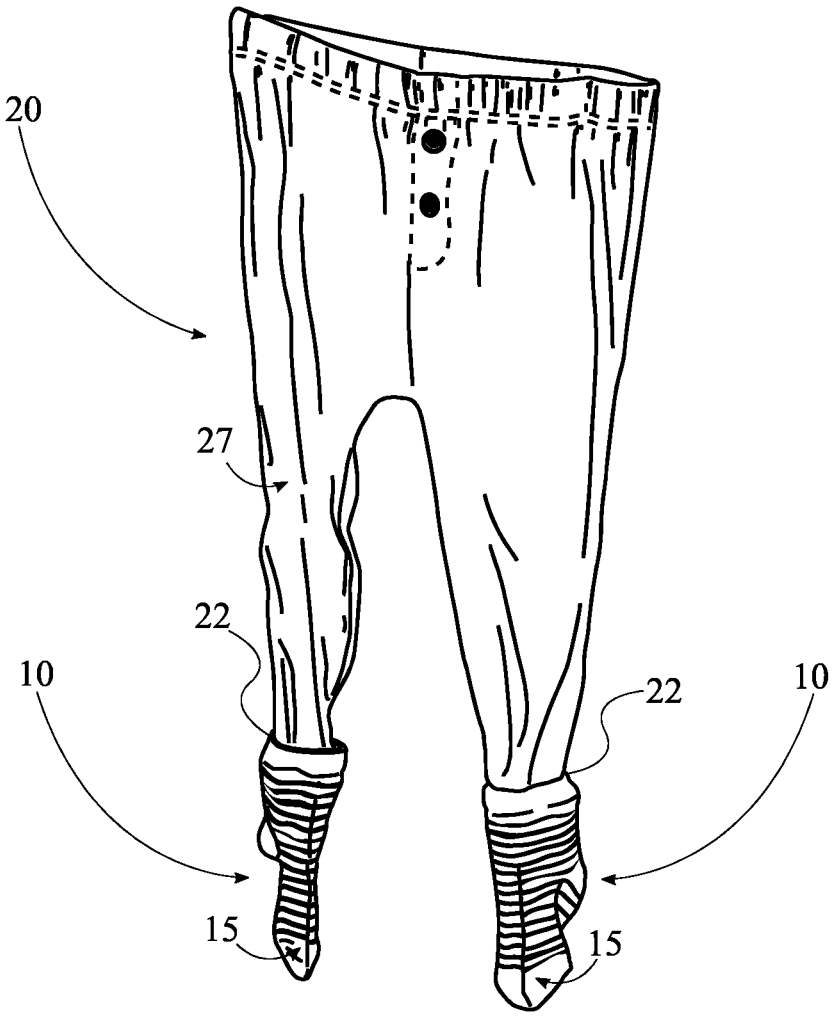
FIG. 5 is an illustration of one embodiment of the present invention, wherein an embodiment of the leg covering is within the foot covering.
Figure 6:
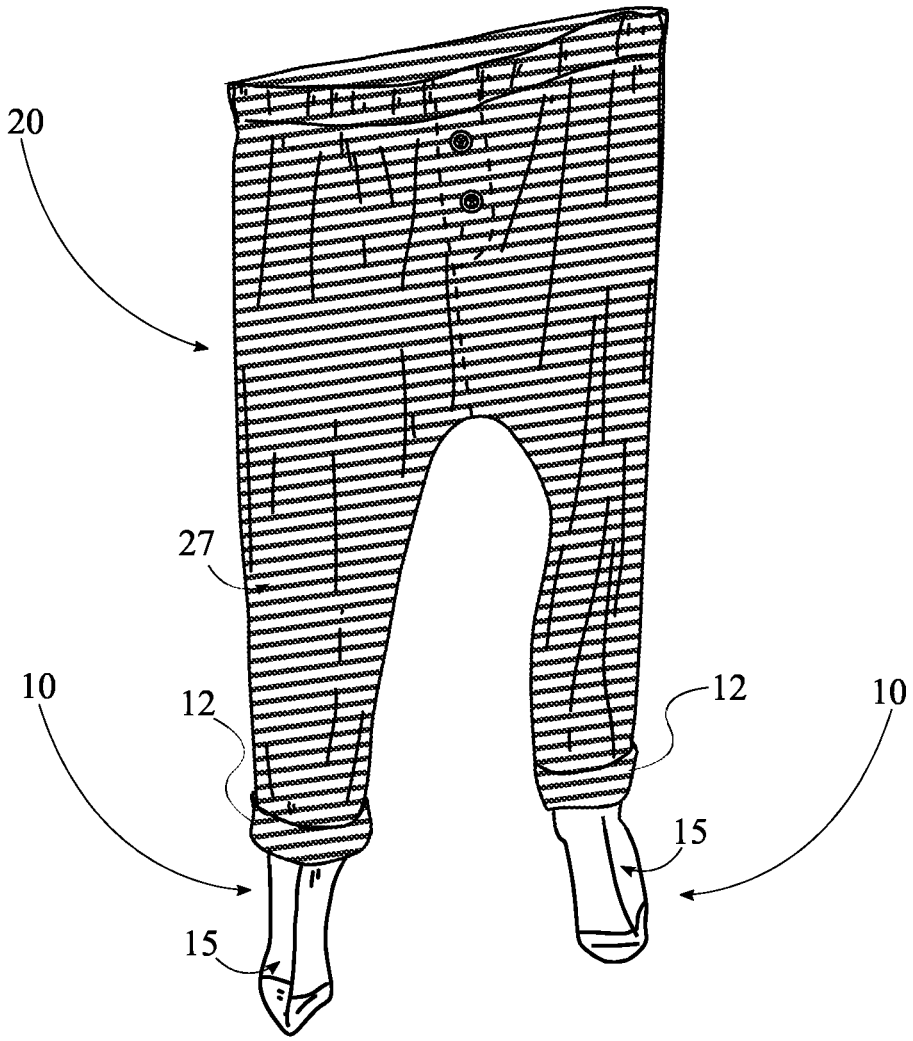
FIG. 6 is an illustration of one embodiment of the present invention, wherein an embodiment of the leg covering is outside of the foot covering in a cuff style.

The foot covering 10 further comprises a first mounting seam 11 and the leg covering 20 further comprises a second mounting seam 21, wherein the first mounting seam 11 and the second mounting seam 21 constitute compatible mounting structures, formations, or fixtures that may be used to attach the foot covering 10 to the leg covering 20 as shown in FIGS. 1, 5, and 6. It is broadly contemplated that the first mounting seam 11 and the second mounting seam 21 may defines features that are created specifically for the purpose of enabling attachment and assembly into a finished instance of the present invention. Additionally, the first mounting seam 11 and the second mounting seam 21 may define existing formations or features of existing garments that are identifiable during assembly as analogous in form or function to the first mounting seam 11 and the second mounting seam 21. The first mounting seam 11 and the second mounting seam 21 are characterized by a thickened material segment, reinforcement, or existing self-attachment seam configured to provide a suitable attachment position for the first mounting seam 11 to the second mounting seam 21, or vice versa. Therefore, the seams arranged about the openings of socks may be identified as instances of the first mounting seam 11 and the leg cuff-seams of conventional pants may be identified as instances of the second mounting seam 21 in at least one conceivable embodiment.

The first mounting seam 11 is engaged to the second mounting seam 21 with at least one interstitial binding 30. As outlined above, the first mounting seam 11 and the second mounting seam 21 may be manufactured as compatible structures in one embodiment, or existing formations of conventional garments may be utilized on an ad hoc basis. The variety of potential disparate garments necessitates a flexible means of attachment, thereby enabling drastically dislike fabrics and textiles to be effectively assembled into the present invention as shown in FIGS. 5 and 6. Accordingly, the at least one interstitial binding 30 is broadly conceptualized to refer to any type or combination of mechanical, chemical, or thermal attachment means as may be realized by a reasonably skilled individual.

Figure 3:
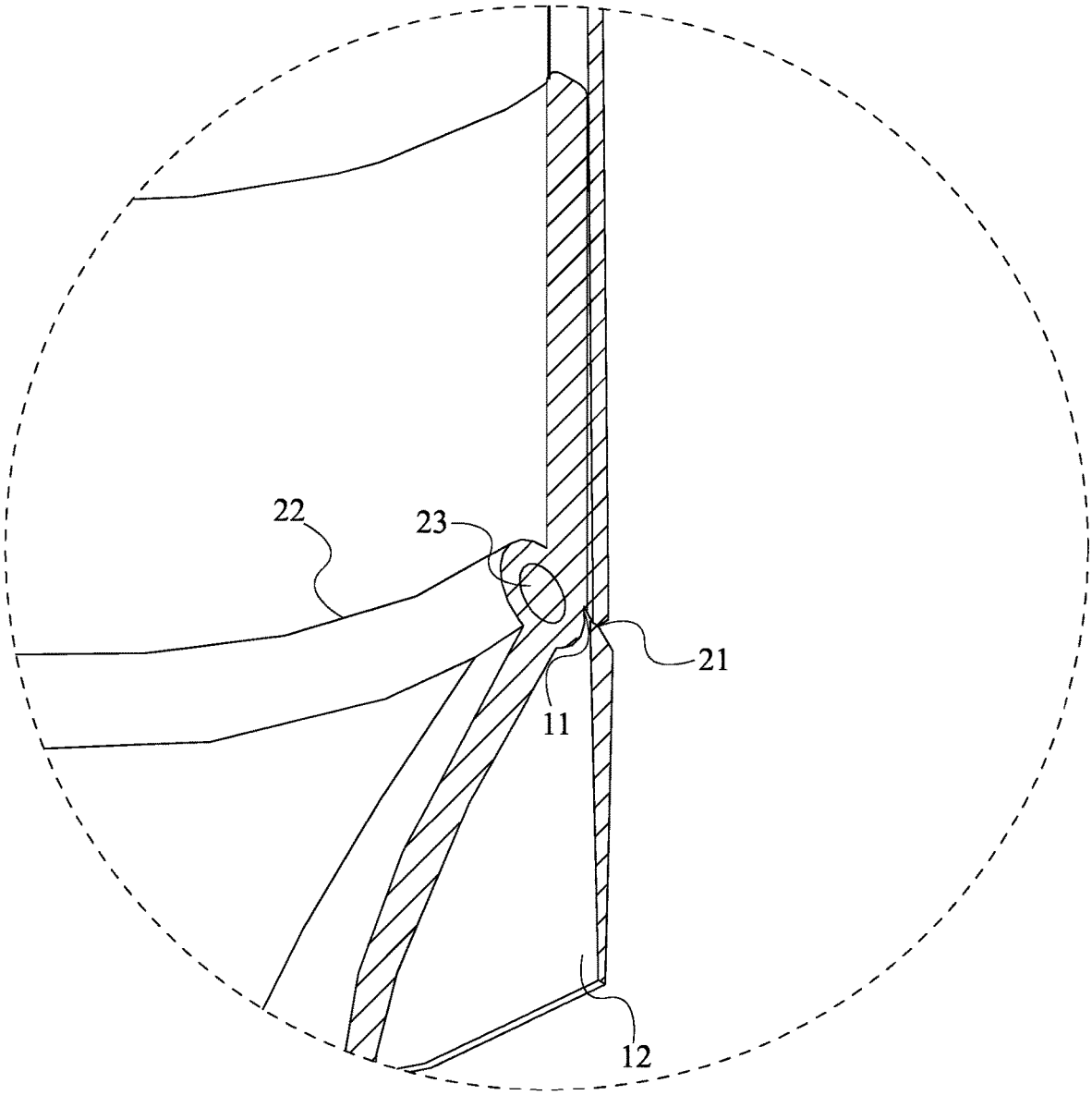
FIG. 3 is a detail view of area 3 in FIG. 2.
Figure 4:
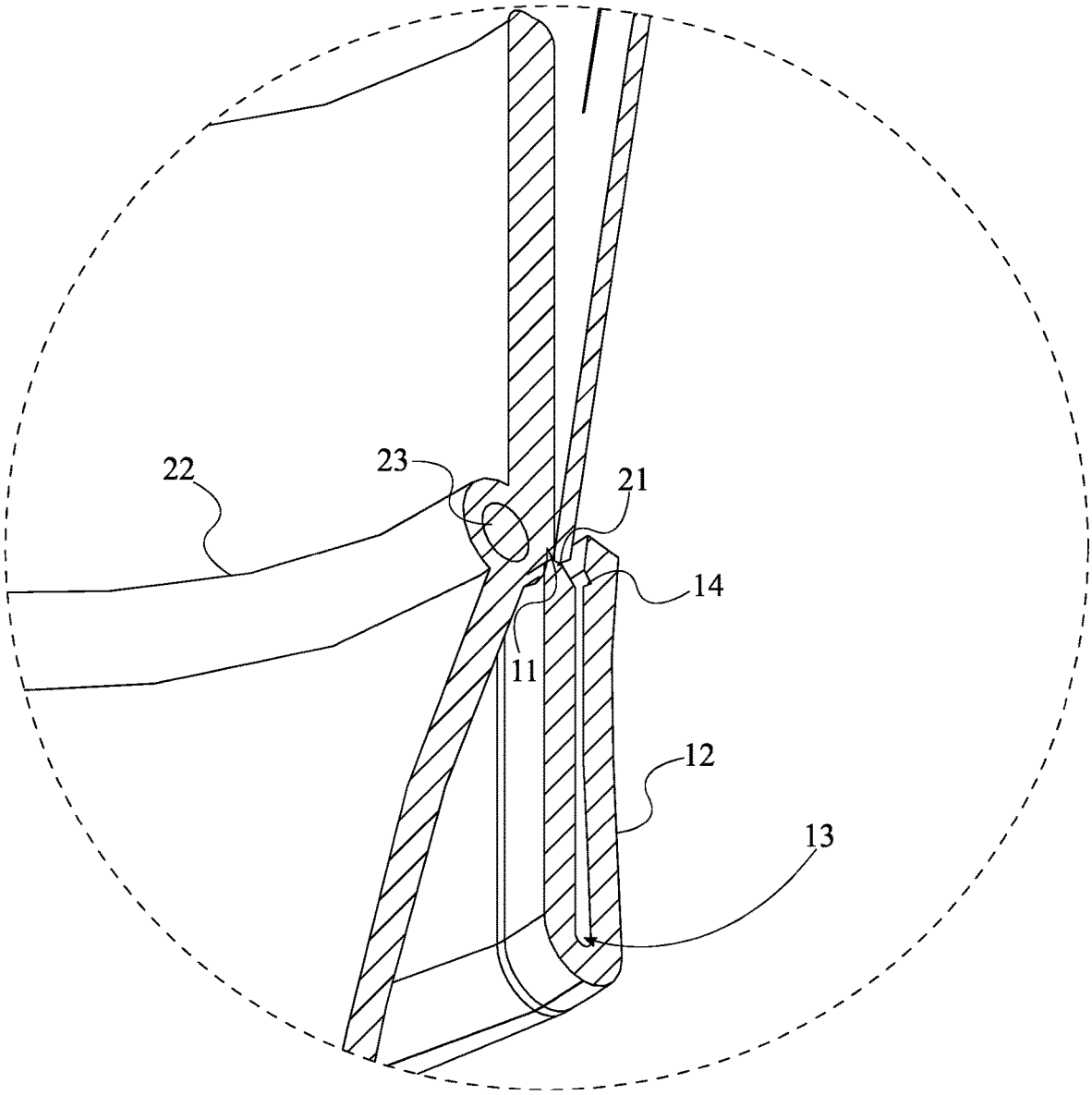
FIG. 4 is a detail view of area 4 in FIG. 2.
Figure 7:
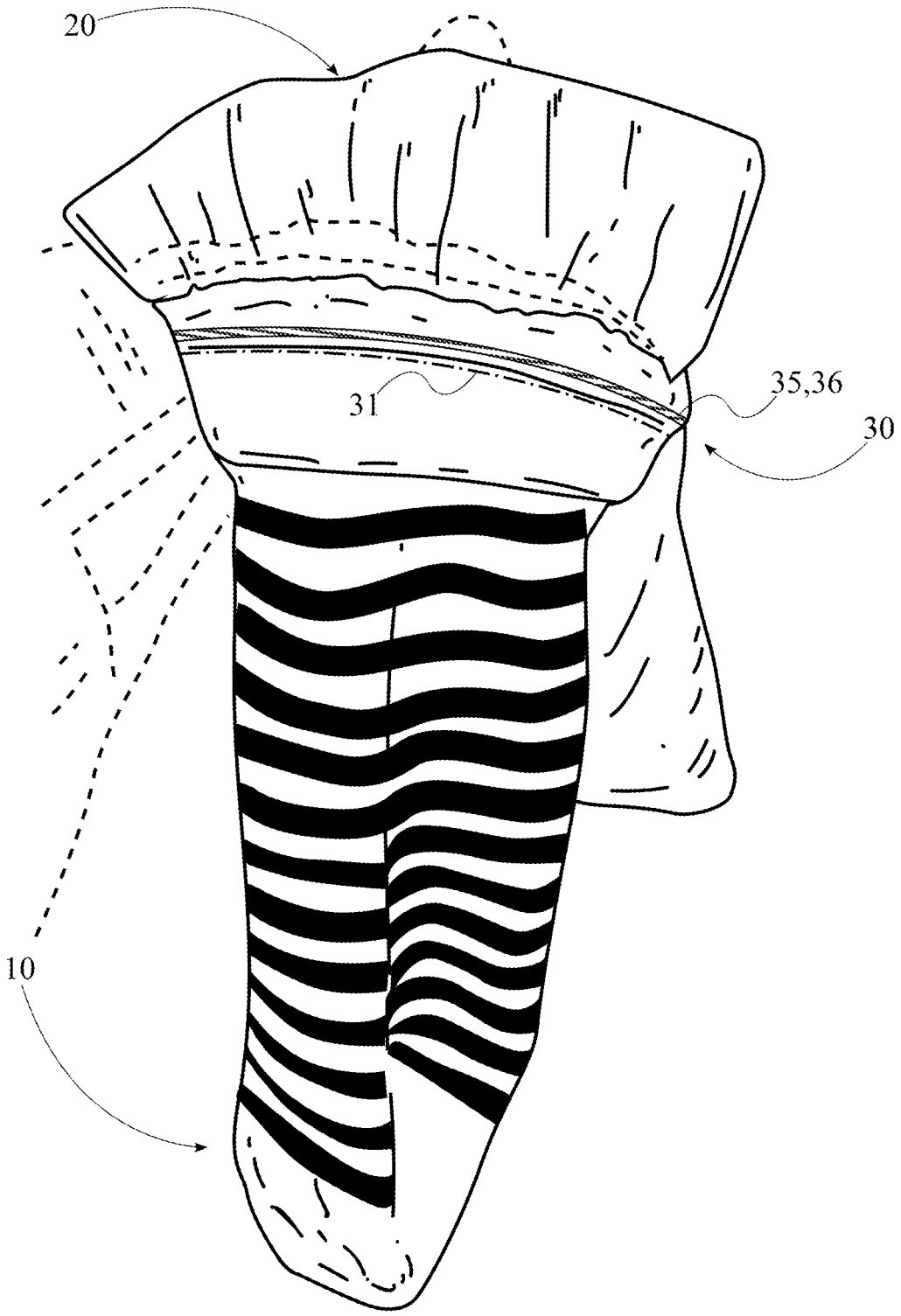
FIG. 7 is a detail view of one exemplary embodiment of the at least one interstitial binding, wherein the interstitial binding is exposed to show construction.

In a preferred embodiment, the at least one interstitial binding 30 being a plurality of stitches 31 as shown in FIG. 7. The plurality of stiches is placed through the foot covering 10 and the leg covering 20 along the first mounting seam 11 and the second mounting seam 21, wherein each of the plurality of stitches 31 ideally penetrates both the foot covering 10 and the leg covering 20 to achieve a 'single-pass' attachment between the otherwise disparate components. More specifically, the plurality of stitches 31 ideally refers to a machine-placed running stitch through the overlapping first mounting seam 11, and the second mounting seam 21. Placement of the plurality of stitches 31 along the first mounting seam 11 and second mounting seam 21 ideally captures reinforced sections of existing pants and socks to provide the most secure attachment between the foot covering 10 and the leg covering 20 possible. As shown in FIGS. 3 and 4, the total material density of the first mounting seam 11 and the second mounting seam 21 is ideally greater than the constituent garments in general.

Figure 8:
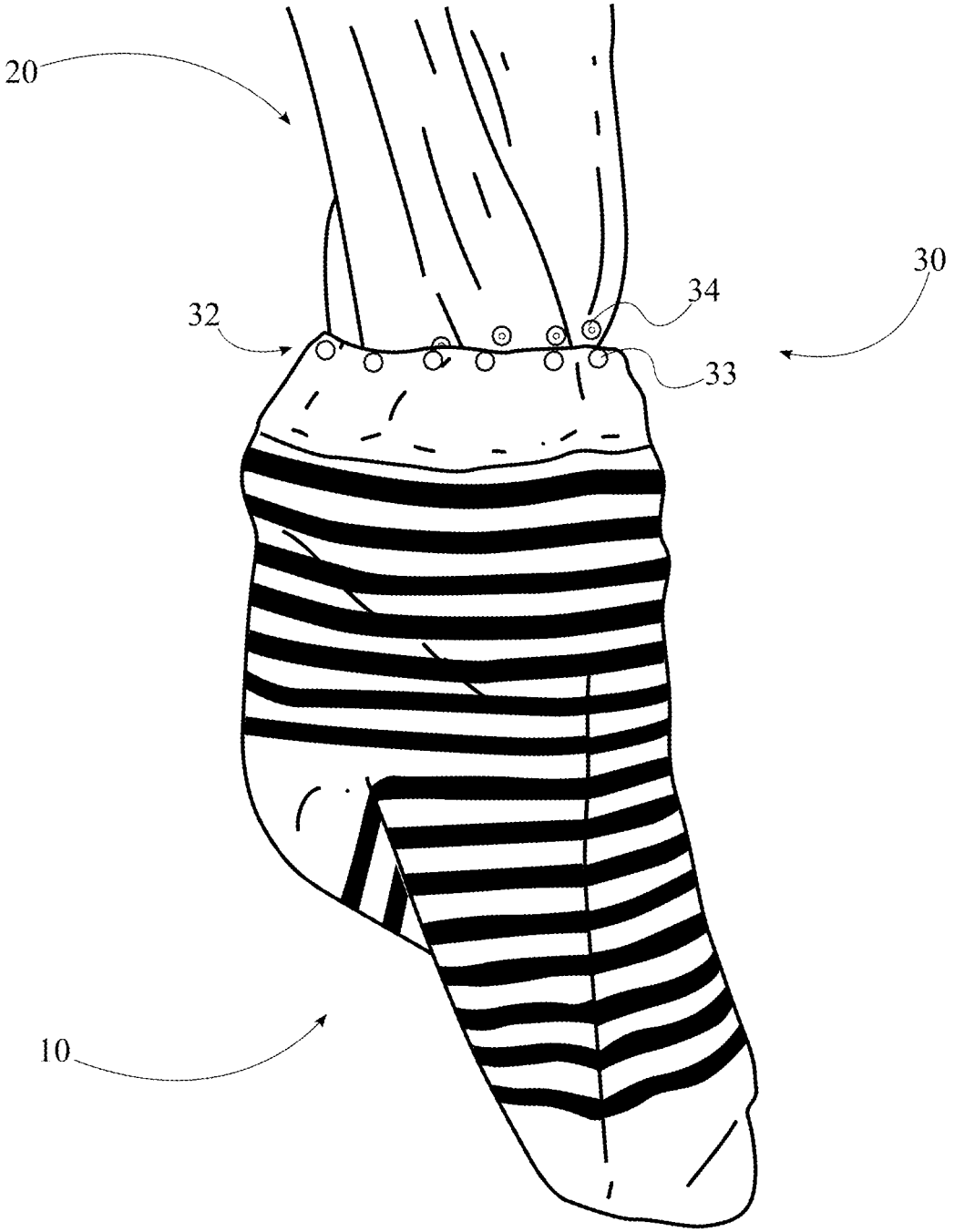
FIG. 8 is a detail view of one exemplary embodiment of the at least one interstitial binding, wherein the interstitial binding is partially disengaged to show construction.

In at least one alternate embodiment shown in FIG. 8, the at least one interstitial binding 30 is a plurality of releasable fasteners 32, wherein each of the plurality of releasable fasteners 32 further comprises a first fastener 33 and a second fastener 34. The first fastener 33 of each of the plurality of releasable fasteners 32 is mounted to the first mounting seam 11 and the second fastener 34 of each of the plurality of releasable fasteners 32 is mounted to the second mounting seam 21, ideally positioned in a matched radial pattern along the first mounting seam 11 and the second mounting seam 21. More specifically, the second fastener 34 positionally corresponds to the first fastener 33 for each of the plurality of releasable fasteners 32, thereby enabling the plurality of fasteners to be fully engaged with no 'orphaned' pairs. The first fastener 33 and the second fastener 34 releasably fix the foot covering 10 and the leg covering 20 to allow the present invention to be selectively configured with alternate embodiments of the foot covering 10 and leg covering 20 as needed. For example, the foot coverings 10 may be exchanged as a wearer transitions from indoor to outdoor environs, or the leg covering 20 may be separated for washing, maintenance, or for aesthetic reasons. I.e., the foot covering 10 and the leg covering 20 may be interchanged as modular elements to allow for customization by a user.

In another embodiment shown in FIG. 7 the at least one interstitial binding 30 is a length of thermal weldment 35, wherein the length of thermal weldment 35 is formed from the first mounting seam 11 and the second mounting seam 21. In this embodiment, the first mounting seam 11 and the second mounting seam 21 may contain prepositioned filler materials or volumes of compatibilized material to enable the formation of a homogenized material attachment between the first mounting seam 11 and the second mounting seam 21, but it is generally proposed that the constituent materials of the foot covering 10 and the leg covering 20 may be configured for attachment by welding without additional additives across various embodiments. The means and methods of utilizing a heat source, ultrasonic generator, or welding iron to permanently affix separate, comparable materials is presumed to be well understood by a reasonably skilled individual and should not be construed as limitations to the type of weldment defined by the length of thermal weldment 35.

In yet another alternate embodiment, the at least one interstitial binding 30 is a volume of chemical adhesive 36 as shown in FIG. 7. The volume of chemical adhesive 36 is applied to adjacent facets of the first mounting seam 11 and the second mounting seam 21, wherein the first mounting seam 11 and the second mounting seam 21 are permanently bonded by the volume of chemical adhesive 36. In one embodiment, the volume of chemical adhesive 36 may act as a bonding agent, mechanically encapsulating and attaching the first mounting seam 11 and the second mounting seam 21 as the volume of chemical adhesive 36 permeates the constituent materials of the foot covering 10 and the leg covering 20. In another embodiment, the volume of chemical adhesive 36 will partially dissolve and compatibilized the first mounting seam 11 and the second mounting seam 21, thereby enabling the foot covering 10 and the leg covering 20 to become materially contiguous across the first mounting seam 11 and the second mounting seam 21.

Figure 2:
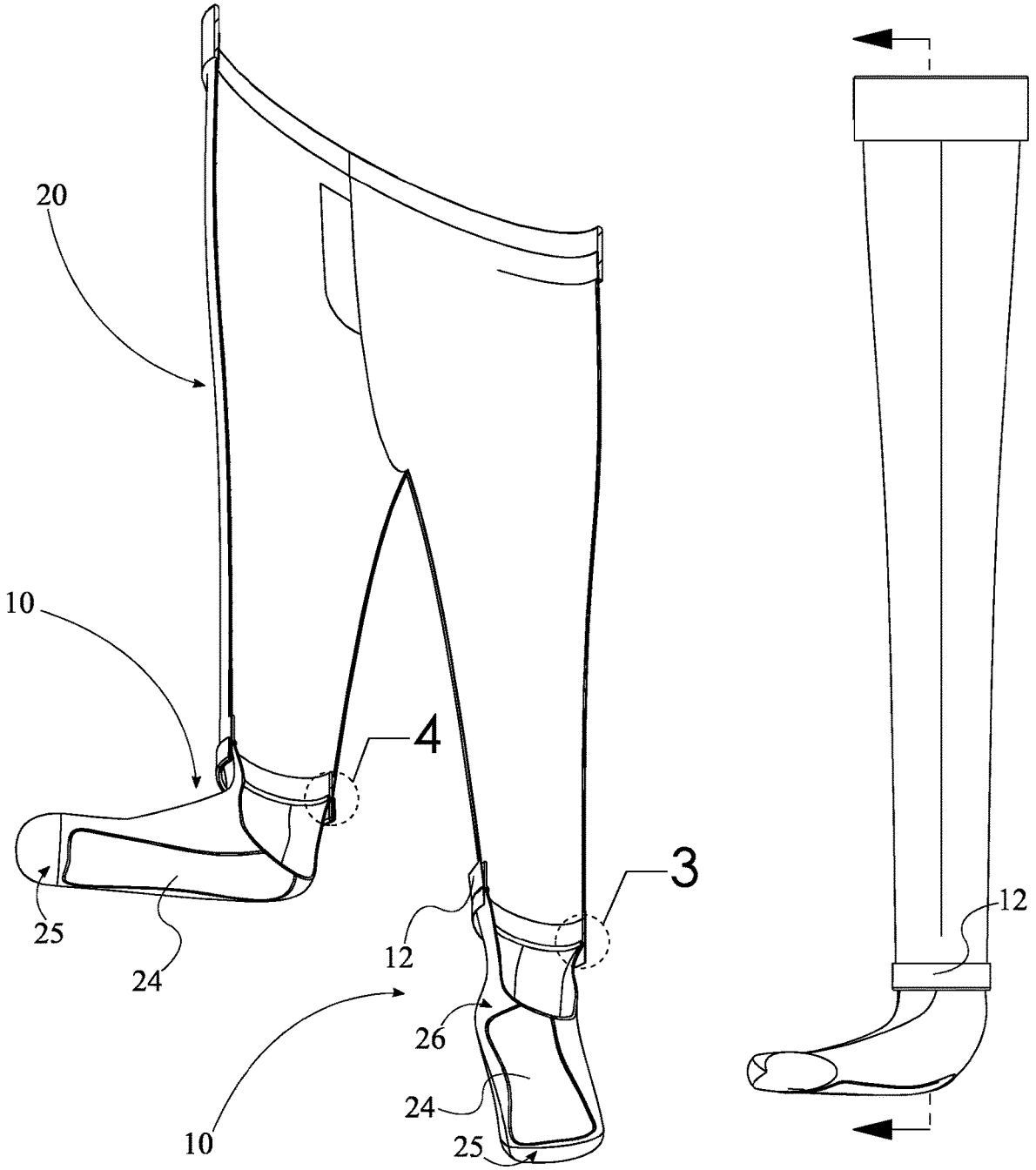
FIG. 2 is a composite section view of the present invention taken along the dashed line.

It is further considered that the use of a singlet onesie may preclude the wearing of shoes, particularly by infants while indoors. Infants are generally not expected to be sure-footed in general and wearing bare sock-material while walking across hard surfaces (wood, tile, etc.) poses a falling hazard. Therefore, the present invention further comprises a traction pad 24 to assist a wearer in maintaining their footing while wearing the present invention. As shown in FIG. 2, the traction pad 24 is mounted to the foot covering 10 opposite the first mounting seam 11, between a toe 25 and a heel 26 of the foot covering 10. This location generally corresponds the sole of a wearer's foot within the foot covering 10, ideally with material concentrations adjacent to the toe 25 and the heel 26 of the foot covering 10 to effectively support the greatest distributions of a wearer's weight. The traction pad 24 ideally defines a textured, rubberized material that is permanently bonded to the foot covering 10 to provide traction in any condition. However, the specific material composition and surface contours of the traction pad 24 are understood to be variable between embodiments without departing from the original spirit and scope of the present invention.

Additionally, it is proposed that the foot covering 10 and the leg covering 20 may be configured to provide the illusory appearance of separate garments while remaining attached. This configuration enables the use of the present invention in pseudo-formal settings wherein a pajama-type garment would be unsuitable. In this embodiment, the foot covering 10 further comprises an ankle band 22 and the leg covering 20 further comprises a hem 12. The ankle band 22 is attached to the first mounting seam 11 and the hem 12 is attached to the second mounting seam 21, creating a material overlap over the conjunction of the foot covering 10 and the leg covering 20 in the preferred embodiment. More specifically, the ankle band 22 is positioned within the leg covering 20 with the hem 12 extending over the foot covering 10. This configuration approximates the normal configuration of a conventional sock and a conventional pant leg upon casual observation. The connection of the first mounting seam 11 and the second mounting seam 21 are camouflaged as conventional seam structures adjacent to the hem 12, and the attachment of the foot covering 10 is hidden within the leg covering 20.

While worn, the foot covering 10 is generally expected to remain in-position on a user's foot due to the inherent tailoring of the leg covering 20 and the foot covering 10. However, a particularly energetic wearer may dislodge the foot covering 10 and entangle themselves in the connected leg covering 20 without some additional means of retention. Accordingly, the ankle band 22 comprises at least one elastic member 23 as shown in FIGS. 3 and 4. The elastic member 23 is configured to constrict the diameter of the ankle band 22, thereby capturing a user's foot within the foot covering 10 as the ankle band 22 constricts around a user's leg.

The outward appearance of the present invention as a conventional pair of pants and socks may be further enhanced by including a thickened or otherwise intentionally complicated structure adjacent to the conjunction of the foot covering 10 and the leg covering 20 as shown in FIGS. 5 and 6. However, any camouflaging structure must conform to conventional stylistic choices present in existing legwear and be concealable into the first mounting seam 11 and the second mounting seam 21, without creating a visually obvious attachment point. To fulfill these functional requirements, the leg covering 20 further comprises a third mounting seam 14 positioned opposite to the second mounting seam 21 across the hem 12. An annular inflection 13 is formed into the hem 12 between the second mounting seam 21 and the third mounting seam 14, and the leg covering 20 is self-attached along the third mounting seam 14 and the second mounting seam 21. The finished structure of the self-attached third mounting seam 14 and the annular inflection 13 is roughly analogous to a conventional pant finished in a cuff, wherein the annular inflection 13 defines the end of the leg covering 20. The third mounting seam 14 defines a generally similar component to the first mounting seam 11 and second mounting seam 21, ideally formed using compatibilized or identical processes. In at least one embodiment, the engagement of the first mounting seam 11, the second mounting seam 21, and the third mounting seam 14 may be executed simultaneously with a single attachment process.

The individual formation of the foot covering 10 and the leg covering 20 prior to attachment enables the use of distinct materials in the construction of each component. This allows the construction of the disparate components to be configured towards a specific role or function in the finished garment, rather than utilizing a single generic composition throughout. For example, the foot covering 10 could be formed from soft, form-fitting materials that may withstand friction wear. In the same instance, the leg covering 20 may be formed of a separate, durable material more suitable to resist wear-damage. Therefore, it is proposed that the foot covering 10 comprises a first textile 15 and the leg covering 20 comprises a second textile 27 as shown in FIGS. 1, 2, 5, and 6. The first textile 15 and the second textile 27 broadly refer to any distinct fabric compositions or hybridized materials typically used in the construction of clothing or as may be realized by a person of ordinary skill. The first textile 15 and the second textile 27 are integrated along the first mounting seam 11 and the second mounting seam 21. The integration of the first textile 15 and the second textile 27 may constitute a material compatibilization or the inclusion of an adhesive filler-material, wherein said integration means would fall under the broad definition of the at least one interstitial binding 30 in all conceivable embodiments.

In at least one specific embodiment the first textile 15 comprises a natural fiber at greater than 90% wt, wherein the first textile 15 is substantially dimensionally stable. This first textile 15 is roughly analogous to the construction of a conventional fitted sock, wherein the fibrous composition is primarily a natural cotton, and the inherent geometry of the sock provides any necessary form-fitting functionalities typically associated with soft footwear. In various alternate embodiments, the inclusion of a percentage of elastic or synthetic materials in the construction of the first textile 15 does not deviate from the original spirit and scope of the present invention, provided that the first textile 15 does not substantially deform or debride during normal use and wear. The dimensional stability of the first textile 15 significantly increases the working life of the foot covering 10 by resisting damage to the sole area of said foot covering 10; such damage being common when the present invention is worn without shoes.

Additionally, the second textile 27 comprises a natural fiber at greater than 70% wt, and synthetic materials at greater than 20% wt in at least one embodiment. The second textile 27 is substantially elastic in this configuration, thereby enabling the leg covering 20 to stretch and expand to target the needs of young children. More specifically, the flexibility of the second textile 27 enables the leg covering 20 to twist and stretch along with a typically rambunctious young wearer without compromising the integrity of the leg covering 20. Further, the elastic qualities of the second textile 27 enable the leg covering 20 to comfortably fit a variety of rapidly-growing wearers without requiring a new instance of the present invention to fit the same wearers every month.

Although the invention has been explained in relation to its preferred embodiment, it is to be understood that many other possible modifications and variations can be made without departing from the spirit and scope of the invention as hereinafter claimed.

What is claimed is:

1. A garment with integrated socks comprising:
- a foot covering comprising a first mounting seam;
- a leg covering comprising a second mounting seam; and
- the first mounting seam being engaged to the second mounting seam with at least one interstitial binding
- the foot covering further comprising an ankle band;
- the leg covering further comprising a hem;
- the ankle band being attached to the first mounting seam;
- the hem being attached to the second mounting seam; and
- the ankle band being positioned within the leg covering, wherein the hem extends over the foot covering.

2. The garment with integrated socks as claimed in claim 1 comprising:
- the at least one interstitial binding being a plurality of stitches; and
- the plurality of stitches being placed through the foot covering and the leg covering along the first mounting seam and the second mounting seam.

3. The garment with integrated socks as claimed in claim 1 comprising:
- the at least one interstitial binding being a plurality of releasable fasteners, wherein each of the plurality of releasable fasteners further comprises a first fastener and a second fastener;
- the first fastener of each of the plurality of releasable fasteners being mounted to the first mounting seam;

the second fastener of each of the plurality of releasable fasteners being mounted to the second mounting seam, wherein the second fastener positionally corresponds to the first fastener; and the first fastener and the second fastener releasably fixing the foot covering and the leg covering.

4. The garment with integrated socks as claimed in claim 1 comprising:

the at least one interstitial binding being a length of thermal weldment; and the length of thermal weldment being formed from the first mounting seam and the second mounting seam.

5. The garment with integrated socks as claimed in claim 1 comprising:

the at least one interstitial binding being a volume of chemical adhesive; and the volume of chemical adhesive being applied to adjacent facets of the first mounting seam and the second mounting seam.

6. The garment with integrated socks as claimed in claim 1 comprising:

a traction pad; and the traction pad being mounted to the foot covering opposite the first mounting seam, between a toe and a heel of the foot covering.

7. The garment with integrated socks as claimed in claim 1 comprising:

the ankle band comprising at least one elastic member; and the elastic member being configured to constrict the diameter of the ankle band.

8. The garment with integrated socks as claimed in claim 1 comprising:

the leg covering further comprising a third mounting seam positioned opposite to the second mounting seam across the hem;

an annular inflection being formed into the hem between the second mounting seam and the third mounting seam; and the leg covering being self-attached along the third mounting seam and the second mounting seam.

9. The garment with integrated socks as claimed in claim 1 comprising:

the foot covering comprising a first textile;

the leg covering comprising a second textile; and the first textile and the second textile being integrated along the first mounting seam and the second mounting seam.

10. The garment with integrated socks as claimed in claim 9 comprising:

the first textile comprising a natural fiber at greater than 90% wt; and the first textile being non-elastic.

11. The garment with integrated socks as claimed in claim 9 comprising:

the second textile comprising a natural fiber at greater than 70% wt, and synthetic materials at greater than 20% wt; and the second textile being substantially elastic.

12. A garment with integrated socks comprising:

a foot covering comprising a first mounting seam;

a leg covering comprising a second mounting seam;

the first mounting seam being engaged to the second mounting seam with at least one interstitial binding;

the foot covering further comprising an ankle band;

the leg covering further comprising a hem;

the ankle band being attached to the first mounting seam;

the hem being attached to the second mounting seam;

the ankle band being positioned within the leg covering, wherein the hem extends over the foot covering;

the leg covering further comprising a third mounting seam positioned opposite to the second mounting seam across the hem;

an annular inflection being formed into the hem between the second mounting seam and the third mounting seam; and the leg covering being self-attached along the third mounting seam and the second mounting seam.

13. The garment with integrated socks as claimed in claim 12 comprising:

the at least one interstitial binding being a plurality of stitches; and the plurality of stitches being placed through the foot covering and the leg covering along the first mounting seam and the second mounting seam.

14. The garment with integrated socks as claimed in claim 12 comprising:

the at least one interstitial binding being a plurality of releasable fasteners, wherein each of the plurality of releasable fasteners further comprises a first fastener and a second fastener;

the first fastener of each of the plurality of releasable fasteners being mounted to the first mounting seam;

the second fastener of each of the plurality of releasable fasteners being mounted to the second mounting seam, wherein the second fastener positionally corresponds to the first fastener; and the first fastener and the second fastener releasably fixing the foot covering and the leg covering.

15. The garment with integrated socks as claimed in claim 12 comprising:

the at least one interstitial binding being a length of thermal weldment; and the length of thermal weldment being formed from the first mounting seam and the second mounting seam.

16. The garment with integrated socks as claimed in claim 12 comprising:

the at least one interstitial binding being a volume of chemical adhesive; and the volume of chemical adhesive being applied to adjacent facets of the first mounting seam and the second mounting seam.

17. The garment with integrated socks as claimed in claim 12 comprising:

a traction pad; and the traction pad being mounted to the foot covering opposite the first mounting seam, between a toe and a heel of the foot covering.

18. The garment with integrated socks as claimed in claim 12 comprising:

the ankle band comprising at least one elastic member; and the elastic member being configured to constrict the diameter of the ankle band.

19. The garment with integrated socks as claimed in claim 12 comprising:

the foot covering comprising a first textile;

the leg covering comprising a second textile;

the first textile and the second textile being integrated along the first mounting seam and the second mounting seam;

the first textile comprising a natural fiber at greater than 90% wt;

the first textile being non-elastic;

the second textile comprising a natural fiber at greater than 70% wt, and synthetic materials at greater than 20% wt; and the second textile being substantially elastic.

* * * * *